United States Patent [19]

Hollenstein et al.

[11] Patent Number: 4,489,300

[45] Date of Patent: Dec. 18, 1984

[54] FUSE HOLDER FOR USE WITH DIFFERENT LINE VOLTAGES

[75] Inventors: Peter Hollenstein, Kriens; Alois Lindenmann, Luzern, both of Switzerland

[73] Assignee: Schurter AG, Luzern, Switzerland

[21] Appl. No.: 555,593

[22] Filed: Nov. 28, 1983

[30] Foreign Application Priority Data

Dec. 14, 1982 [CH] Switzerland ..... 7263/82

[51] Int. Cl.[3] ..... H01H 85/02; H01H 85/20

[52] U.S. Cl. ..... 337/186; 337/197; 337/230; 361/357

[58] Field of Search ..... 337/230, 4, 5, 197, 337/198, 241, 265, 228, 229, 257, 186, 187, 189; 339/147 P, 113; 361/334, 357, 430, 432

[56] References Cited

U.S. PATENT DOCUMENTS 3,222,478 12/1965 More ..... 337/197

4,385,282 5/1983 Ahroni ..... 337/198

4,411,486 10/1983 Behrendt ..... 337/198

*Primary Examiner*—Harold Broome

*Attorney, Agent, or Firm*—Werner W. Kleeman

[57] ABSTRACT

The head member of the fuse holder can be removed from a socket member along an insertion axis when pressure is brought to act on spring detents or latches. The non-similarity of the spring detents ensures that the head member only can be inserted into the socket member in one predetermined orientation or position. The fuse holder which, for instance, is a two-pole fuse holder, in addition to an entirely conventional fuse and the associated holder including connection tabs in the socket member, comprises a further fuse which is associated with a line voltage preselector. For this purpose a selector insert is removably seated and locked into position in the head member along the insertion axis. A connecting conductor finger of the selector insert, depending on its rotary position within the head member, contacts a preselectable one of four lateral or side connection tabs. Therefore, the voltage cannot be unintentionally misadjusted when a fuse is exchanged.

14 Claims, 9 Drawing Figures

A
IX
1'
10'
20'
30'
3'
32'
41'
45'
30''
42'
33'
2'
1051'
40'
4'
105'
40
50'
43'
21'
5'
44'
211'
51'
21'
212'
22'
21'
IX

A
20'
3'
45'
41'
10'
1'
2'
4'
40'
40'
33'
33'
42'
44'
21'
21'
21'
21'
22'

FUSE HOLDER FOR USE WITH DIFFERENT LINE VOLTAGES

CROSS-REFERENCE TO RELATED APPLICATIONS

This application is related to (i) the commonly assigned, copending U.S. application Ser. No. 06/402,308, filed July 27, 1982, now U.S. Pat. No. 4,453,794, entitled "Fuse Holder, Especially Fuse for Miniaturized Fuses" and (ii) the commonly copending assigned U.S. application Ser. No. 06/439,882, filed Nov. 8, 1982, and entitled "Fuse Holder, Especially Fuse for Miniaturized Fuses".

BACKGROUND OF THE INVENTION

The present invention relates to a new and improved construction of a fuse holder or the like.

In its more particular aspects, the present invention relates specifically to a new and improved construction of fuse holder designed for use with different line voltages and including a line voltage preselector.

A fuse holder including a voltage preselector and integrated with an electrical socket is commercially available (known as type GCC, No. 42R34 and 42R38 and available from the German firm Klar & Beilschmidt, P.O. Box 2529, D-8300 Landshut 2, Federal Republic of Germany or from the U.S. firm Power Dynamics, Inc., 177 Valley Street, South Orange, N.J. 07070, U.S.A.). In the known constructions lateral or side connection tabs extend close to an opening in the socket member, so that there is no contact protection. The voltage is selected by inserting a head member into the opening of the socket member in a selected one of four possible rotary positions. Consequently, the voltage selection must be reselected each time the fuse is exchanged. Miniature numbers at the head member and an exceedingly small mark must be brought into coincidence during this operation. This not only constitutes a source of danger for laymen, but also can result in serious confusion.

SUMMARY OF THE INVENTION

Therefore with the foregoing in mind it is a primary object of the present invention to provide a new and improved construction of a fuse holder designed for use with different line voltages and including a line voltage preselector, which is not afflicted with the aforementioned drawbacks and limitations of the prior art constructions heretofore discussed.

Another and more specific object of the present invention is directed to the provision of a new and improved fuse holder designed for use with different line voltages and including a line voltage preselector and which possesses an economically advantageous design and which can be advantageously economically manufactured.

Now in order to implement these and still further objects of the invention, which will become more readily apparent as the description proceeds, the fuse holder of the present development is manifested by the features that, in the head member there is removably seated in a position which corresponds to a preselected voltage, a selector insert or insert member which can be inserted in one of a number of preselectable positions, each of which corresponds to a selected line voltage, and the selector insert contains a connecting conductor comprising a connecting or connection section for providing an electrically conductive contact to an outer cap member at the fuse and further comprises a connecting conductor finger for providing an electrically conductive contact to one of a number of lateral connection tabs at the socket member, each of which corresponds to a respective one of the preselectable positions of the selector insert.

Since the position of the selector insert in the socket member is decisive for the preselected voltage, the voltage does not have to be newly preselected each time the fuse is exchanged as long as the selector insert is not removed from the head member. This is particularly true also in the case that the head member only can be inserted into the socket member in one single predetermined position or orientation.

According to a preferred embodiment of the fuse holder according to the invention, the selector insert can be inserted into the head member transversely with respect to the insertion axis. A number of insertion positions can be provided in juxtaposition or adjacent one another in the socket member and corresponding lateral connection tabs in the socket member are then operatively associated with each one of the number of insertion positions. In this case it is also possible to still accommodate a further live fuse in the same head member when, for example, in addition to the selector insert a corresponding additional insert or insert member is provided and the socket member is correspondingly connected. Such a design is both space-saving and compact and can be manufactured with an advantageous short length using a laterally displaced primary connection tab. In such a construction the lateral connection tab is preferably arranged opposite the primary connection tab. This enables the connection tab to be positioned deeply within the socket member which is of advantage with respect to contact protection.

According to a further preferred embodiment of the fuse holder according to the invention, the selector insert or insert member can be inserted along the insertion axis into the head member in different rotary positions, each of which corresponds to a respective voltage selection. Such a design is at least laterally even more space-saving than the first mentioned design and permits the primary connection tab, in a conventional arrangement, to be constructed as a base connection member which is of short length and protected from being contacted. A second live fuse can be accommodated in a space-saving fashion in the same head member provided that the socket member or socket contains corresponding connections. Both embodiments, particularly the latter, can be advantageously integrated with a plug or socket, the housing of which may then provide the socket member of the fuse holder. An arrangement which is devised such that the head member can only be removed after the plug has been withdrawn, can be realized in known manner, however, is not absolutely required provided the fuse holder is contact protected.

Both of the aforementioned embodiments of the inventive fuse holder equally permit retaining the head member in the socket member, preferably in a snap-in manner. Specifically, in the second embodiment the snap-in of the selector insert into the head member can be realized in an extremely simple manner. In this way high operational reliability is achieved in addition to handling convenience. Provisions may be made so that a removal of the head member from the socket member and/or a change in the voltage preselection by removing and re-inserting the selector insert from or into the head member, as the case may be, can only be accomplished by either using a suitable tool like, for example, a screwdriver or only after performing a predetermined additional action or manipulation.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 2:
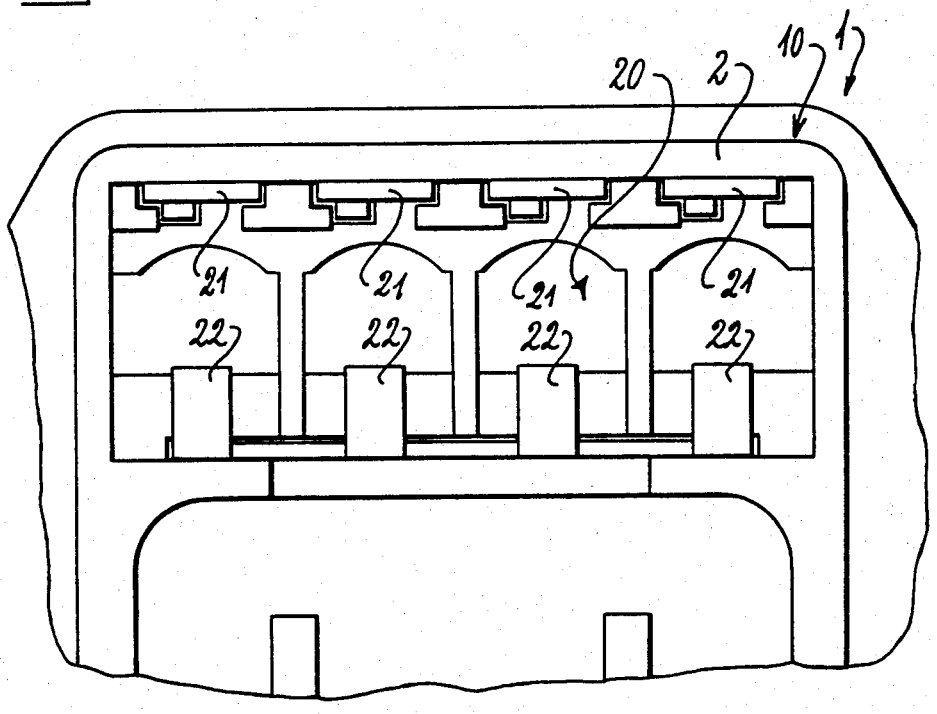
FIG. 2 is a fragmentary view on an enlarged scale in comparison to FIG. 1 depicting a detail of the instrument plug shown in FIG. 1 in which a head member has been removed from the socket member of the fuse holder.

Describing now the drawings, it is to be understood that only enough of the construction of the fuse holder and its related structure has been shown as needed for those skilled in the art to readily understand the underlying principles and concepts of the present development, while simplifying the showing of the drawings. Turning attention now specifically to FIGS. 1, 2, 3 and 5 of the drawings, there is shown therein a first exemplary embodiment of fuse holder constructed according to the present invention and which is incorporated into an instrument plug to form a combined socket and plug arrangement.

The plastics housing 2*a* of the instrument or apparatus plug 1 serves as the socket member 2 of the fuse holder. The socket member 2 comprises an opening 20 in which a head member 3 is seated which is of substantially rectangular shape in the top plan view of FIG. 1. This head member 3 is removably held in the socket member 2 by means of a spring detent 30 which is formed integrally therewith. Removal of the head member 3 from the socket member 2 along an insertion axis A can be accomplished by appropriately applying, for instance, a screwdriver at the location S in FIG. 1. The head member 3 thus actually only can be removed when no counter element is seated in the plug 1, i.e. when the arrangement is so-to-speak dead or out-of-circuit. Considering that the inventive fuse holder is protected from contact, such precaution would not be necessarily required. The plug 1 has a plug portion 1*a* containing protruding pins 1*b* and serving to receive a suitable power cord for connection with the power supply.

The fuse holder 10 which is integrated with the plug 1 is a one-pole fuse holder comprising four possible voltage selections. Of course, also a greater number of fuses and/or possibilities for voltage selection can be realized; however, in such case the dimensioning would become somewhat problematic with respect to integration of the fuse holder with such an instrument or apparatus plug 1.

Figure 3:
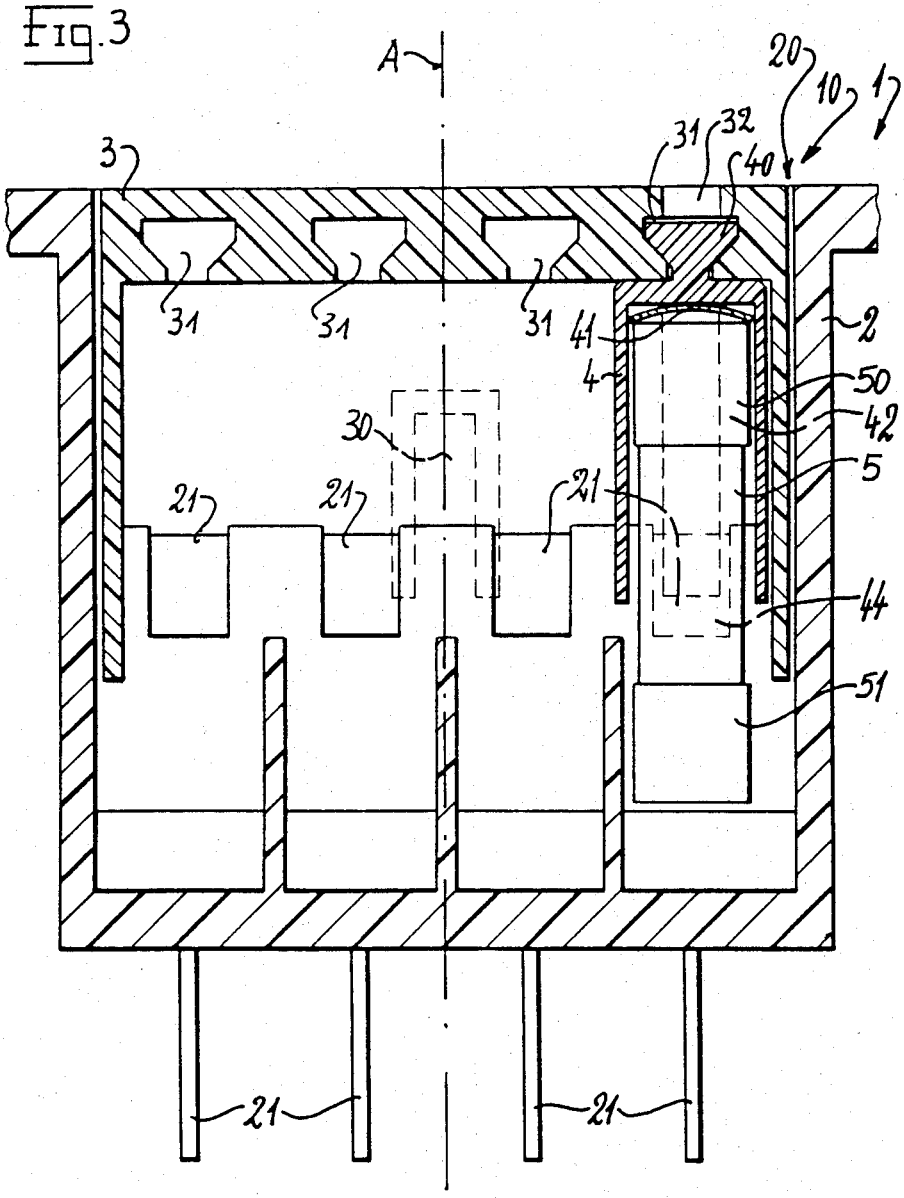
FIG. 3 is an enlarged sectional view taken substantially along the line III—III of FIG. 1.

At the head member 3 there are provided dovetail grooves 31 disposed in an adjacent arrangement with respect to one another and which extend transversely relative to the insertion axis A, as best seen by referring to FIG. 3. These dovetail grooves 31 are each structured to receive a selector insert 4. In the depicted embodiment the selector insert 4 is arranged at the extreme right of the showing of FIG. 3 and it will be assumed that this position corresponds, for instance, to a line voltage of 220 V. Thus, the indication "220 V" is visible in the right-hand viewing window 32 of FIG. 1. These windows 32 are arranged in an offset fashion in a step-like configuration, so that an indicating number or marker corresponding to each window can be provided at the respective dovetails 40 of the selector insert 4. The indicating number appears in the corresponding window 32 when the selector insert 4 is inserted into the related dovetail groove 31. Wrong insertion and improper engagement with one of the dovetail grooves 31 can be prevented by virtue of the asymmetric construction of the mating dovetail member 40 as indicated in FIG. 5.

Figure 5:
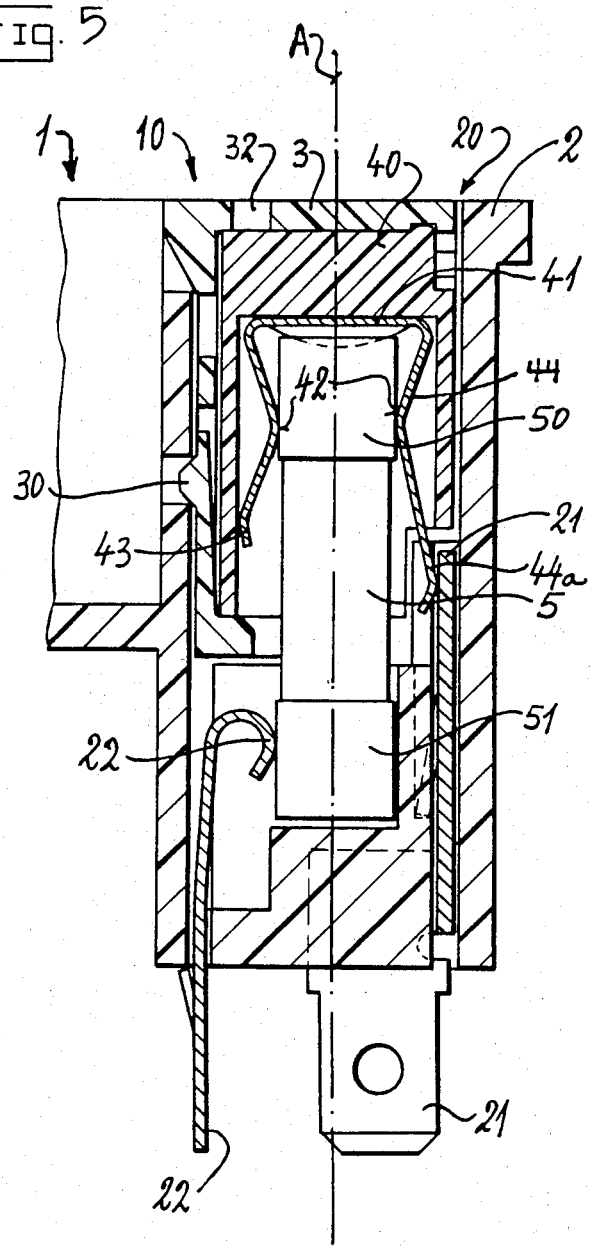
FIG. 5 is an enlarged sectional view taken substantially along the line V—V of FIG. 1.
Figure 6:
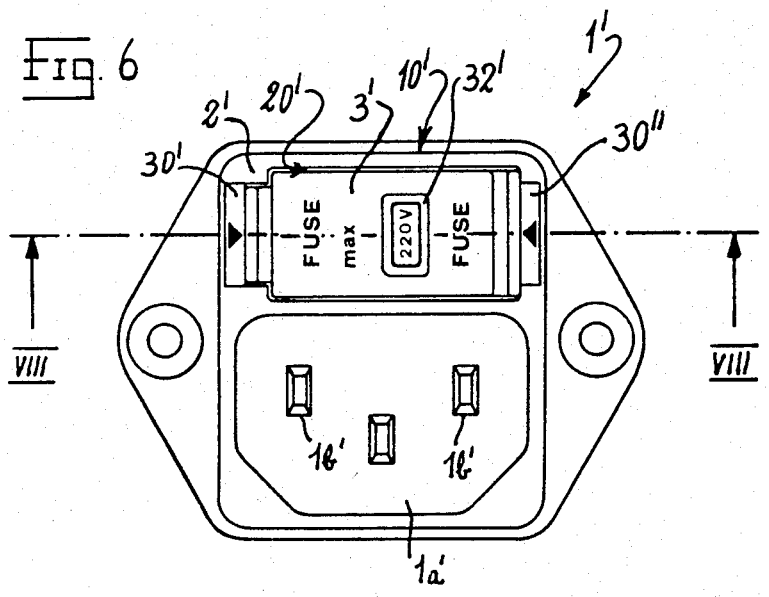
FIG. 6 is a top plan view of a further embodiment of instrument plug containing a third embodiment of fuse holder according to the invention which includes an integrated line voltage selector.
Figure 7:
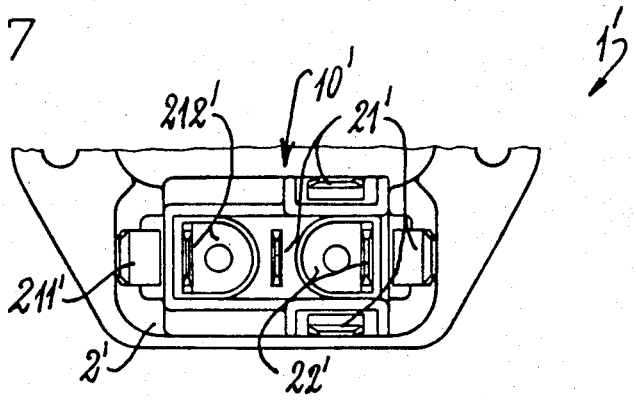
FIG. 7 is a fragmentary rear view of part of the instrument plug shown in FIG. 6 and depicting the rear side of the fuse holder.
Figure 8:
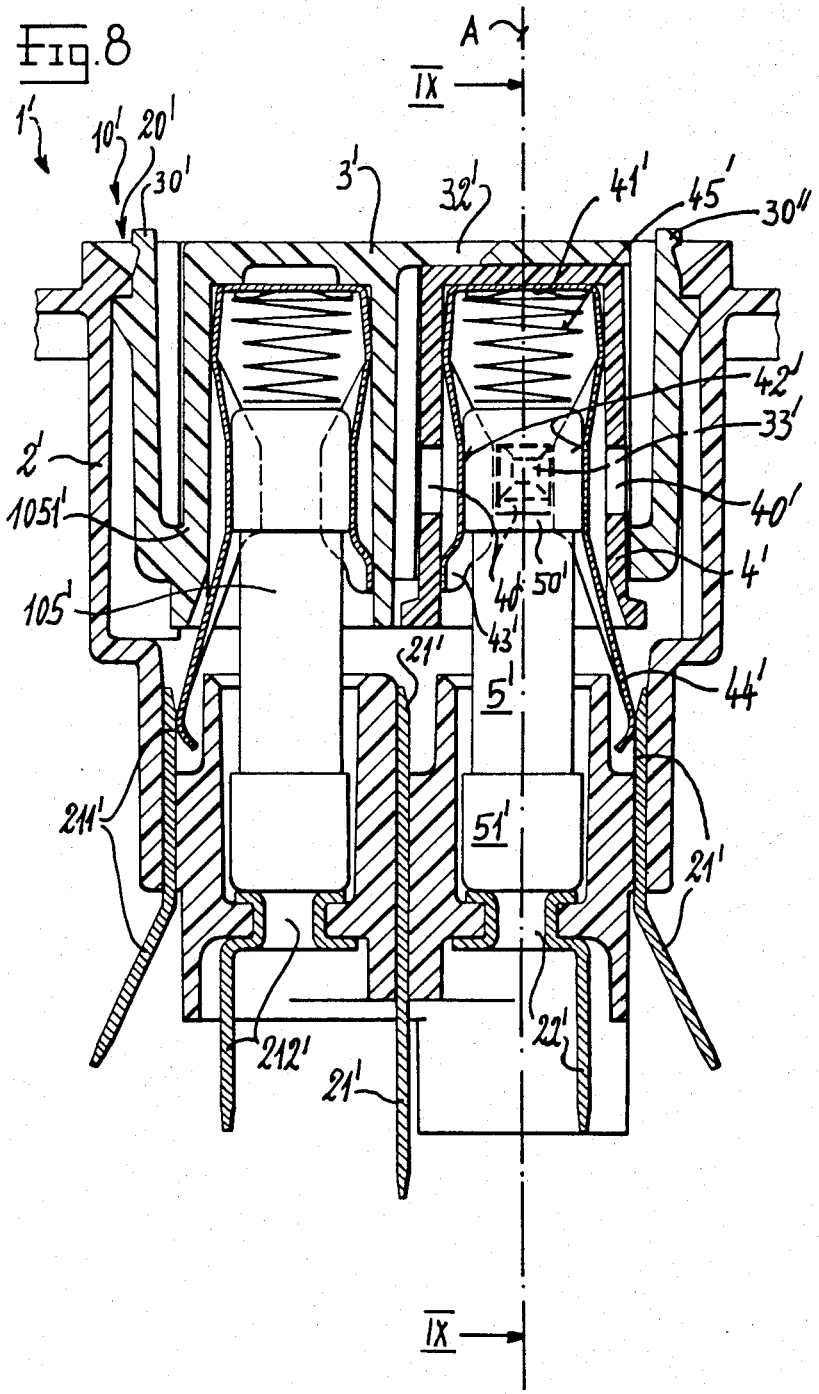
FIG. 8 is an enlarged sectional view taken substantially along the line VIII—VIII of FIG. 6.
Figure 9:
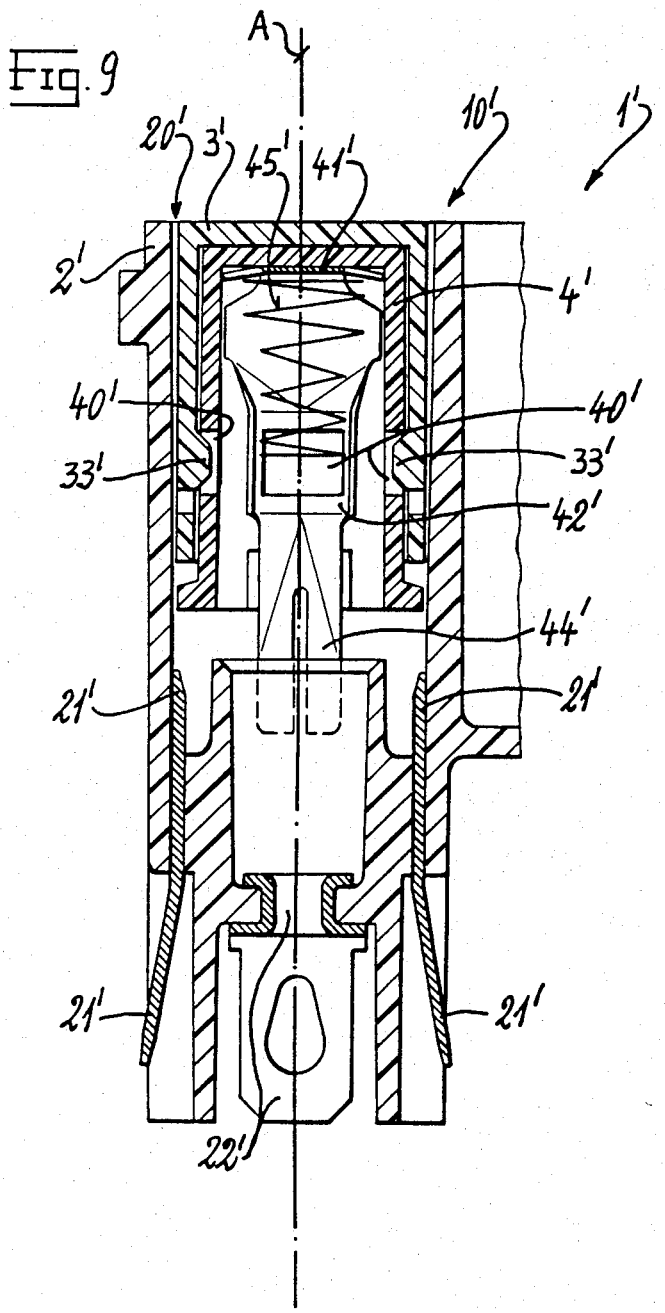
FIG. 9 is a sectional view taken substantially along the line IX—IX of FIG. 8.

In the selector insert 4 there is provided a connecting conductor 41 having a substantially U-shape and provided with two unequal legs or leg members 43 and 44 which converge to form a contact section 42, as shown in FIG. 5. This contact section 42 establishes an electrically conductive contact with an outer cap member 50 of a fuse 5 and retains this fuse 5 within the head member 3. The shorter leg 43 of the U-shaped connecting conductor 41, see FIG. 5, extends from the contact section 42 inwardly towards the inner wall of the selector insert 4 and serves as a support. The other longer leg 44 of the U-shaped connecting conductor 41 forms a connection conductor finger 44*a* in order to provide an electrically conductive contact with a secondary lateral connection tab or contact 21 which corresponds to the position of the selector insert 4 in the head member 3 when the latter is inserted into the socket member 2. The lateral connection tabs or contacts 21 are separately outwardly extended or prolonged and can be connected in known manner, not here shown in any particular detail, with a related piece of equipment or the like which is to be powered.

Primary connection tabs or contacts 22 are laterally arranged and one of these primary connection tabs 22 is contacted by the inner cap member 51 of the fuse 5. All of the primary connection tabs or contacts 22 are interconnected unless there are specific reasons which demand a separate connection.

Depending upon the interconnection or separate connection of the primary connection tabs or contacts 22 and depending upon the connection of the lateral connection tabs or contacts 21, and furthermore, depending upon the selected design of the head member 3 which may have various other designs in addition to the designs shown, one pole including four possibilities of voltage selection, two poles including three possibilities of voltage selection or three poles including only two possibilities of voltage selection can be combined with the same socket member 2. Further variants can be achieved by using a socket member 2 which contains a greater number of lateral connection tabs or contacts and a greater number of primary connection tabs or contacts.

Since the lateral connection tabs or contacts 21 can be arranged deep within the socket member 2 and since the primary connection tabs 22 are located even deeper therein, the desirable protection against contact can be achieved as will be readily evident. The oppositely situated arrangement of the connection tabs 21 and 22 aids in maintaining low the overall height of the combined socket and plug arrangement with its fuse holder.

Figure 4:
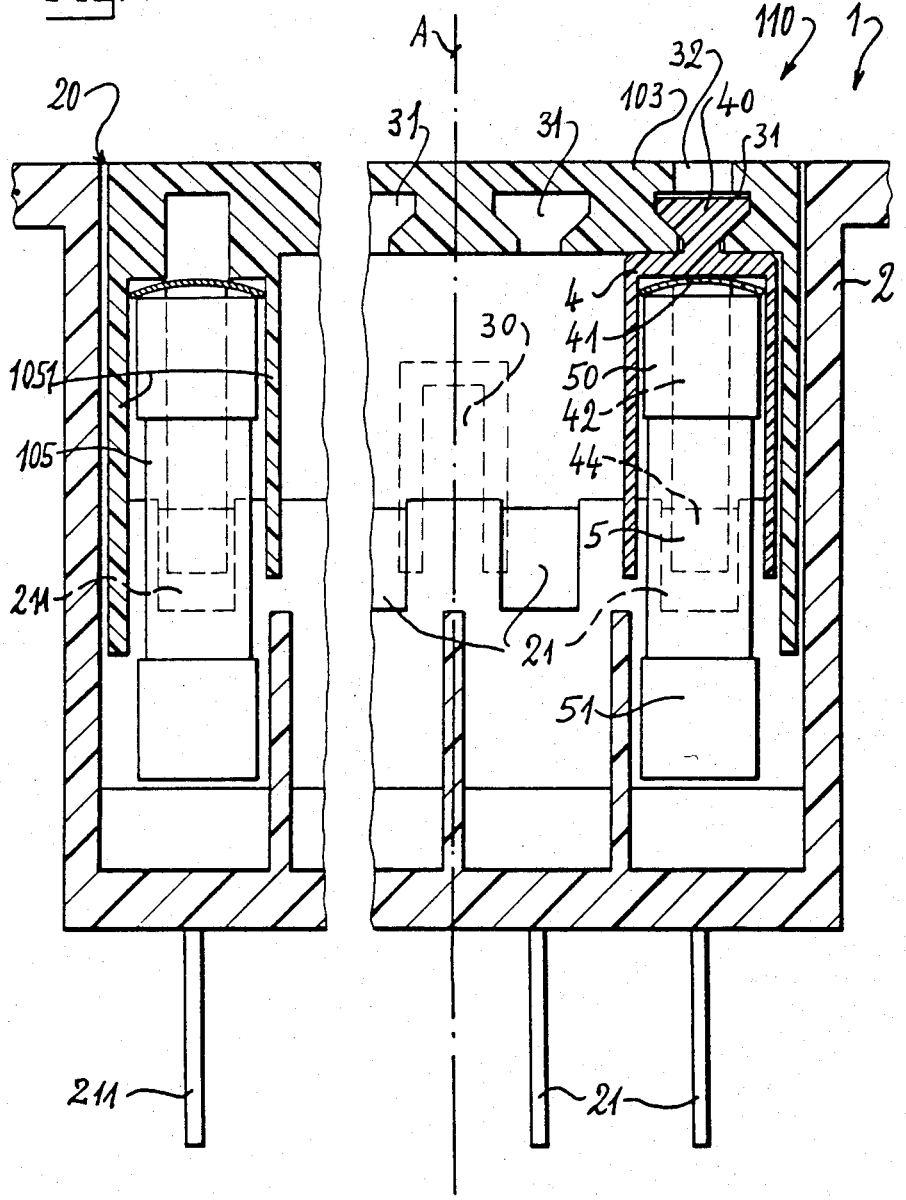
FIG. 4 is a sectional view corresponding to FIG. 3 of an instrument plug incorporating a second embodiment of the fuse holder according to the invention.

A second embodiment of the inventive fuse holder 110 is illustrated in FIG. 4 in a sectional view which is similar to the showing of FIG. 3. A substantially rectangular head member 103 is seated in the socket member 2 and this head member 103 can be removed from the socket member 2 along the insertion axis A by applying, for instance, a screwdriver at the location S as such has already been previously described with reference to FIG. 1. Thus, the head member 103 actually only can be removed when there is no counter element present in the instrument plug 1, i.e. when the arrangement is so-to-speak dead or out-of-circuit. This second embodiment of inventive fuse holder differs from the first embodiment of fuse holder as described hereinbefore, by virtue of the fact that the head member 103 contains protected poles, two live fuses 5 and 105 as well as a voltage selector enabling three possibilities of voltage selection. Of course, here too also a greater number of fuses and/or possibilities of voltage selection can be realized, but again, the dimensioning would then be somewhat problematic for the integration into the instrument or apparatus plug 1.

Figure 1:
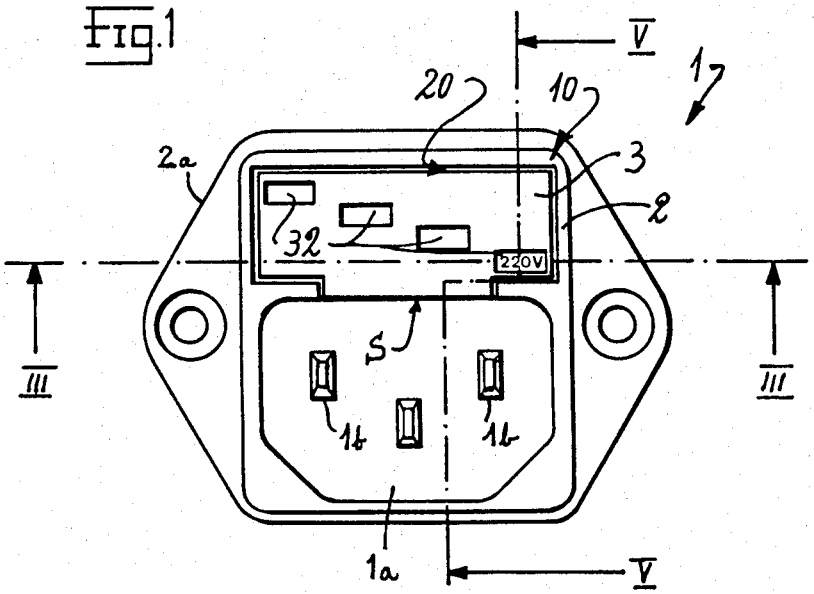
FIG. 1 is a top plan view of an instrument plug containing a first embodiment of fuse holder constructed according to the present invention and a line voltage selector integrated therewith.

With respect to the arrangement of the selector insert 4 in the head member 103, the fuse holder 110 of this embodiment does not differ from the fuse holder 10 of the embodiment of FIG. 1. Thus, adjacently arranged dovetail grooves 31 are here also provided in order to receive the selector insert 4 and again a voltage indication is provided at respective windows 32. A connection conductor 41 has essentially the same construction and provides the same connections as described hereinbefore with reference to the first embodiment of the inventive fuse holder depicted in FIGS. 1, 2, 3 and 5. However, the design of the head member 103 is somewhat different in that it provides separate primary connection tabs. A special holder or retainer 1051 is provided for a further live fuse 105, so that the associated lateral connection tab or contact 211 and the primary connection tab, which is not visible in FIG. 4, are associated with different conductors as compared to the connection tabs 21 and 22 for the fuse 5 in FIG. 3. For example, the fuse 105 serves to protect a neutral conductor or line and may assume a voltage-independent position. On the other hand, the fuse 5 and the associated selector inserts 4 are arranged in accordance with the correspondingly preselected voltage.

In the second embodiment of the inventive fuse holder 110 the same socket member 2 is used as in the first embodiment described hereinbefore. Also the same combinations of poles and voltage selections can be provided and protection from contact is achieved in the same manner.

A third embodiment of inventive fuse holder is shown in FIGS. 6 to 9 of the drawings and will be described hereinafter.

In such third embodiment of fuse holder 10' the socket member 2' of this fuse holder 10' is also integrated with the plastic housing 2a' of an instrument or apparatus plug 1'. A head member 3' can be removed from the socket member 2' through a socket opening 20' along the insertion axis A provided that non-identical spring detents 30' and 30'' are inwardly pressed. As will be evident from FIG. 6, these spring detents 30' and 30'' are of unequal width and thus prevent unintentional wrong insertion of the head member 3' into the socket member 2'. To remove the head member 3' from displaced from their locking position which is also possible in the plugged-in condition of the instrument or apparatus plug 1'. Such operation can be carried out without any problems due to the protection of the fuse holder 10' from contact. The head member 3' thus can be readily removed without using any kind of tool. Here too the plug 1' has a plug portion 1a' containing protruding pins 1b' and serving to receive a suitable power cord for connection with the power supply.

The fuse holder 10' as illustrated in FIGS. 6 to 9 is provided with two protected poles, and thus, also includes two live fuses 5' and 105' as well as a voltage selector including four possibilities of voltage selection. Of course, a greater number of fuses and a greater number of possibilities of voltage selection could be realized in an analogous manner; however, such could result in larger dimensions or a greater technical expense which is generally unnecessary for such an instrument or apparatus plug 1'.

As already stated, the head member 3' only can be inserted in one direction into the socket member 2', so that the fuse 105' in its holder or retainer 1051' will always be operatively associated with the lateral connection tab or contact 211' and with the primary connection tab or contact 212', while the other fuse 5' will always be operatively associated with the primary connection tab or contact 22', however, with one of four lateral connection tabs or contacts 21' in a manner which is still to be described. An inner cap member 51' of the fuse 5' is solidly pressed against the primary connection tab 22' which is located at the base or foot side, by means of a compression spring 45' or equivalent structure which acts on an outer cap member 50' of such fuse 5'. The spring 45' will push the head member 3' away from the socket member 2' when the spring detents 30' and 30'' are released. The inner cap member 51' of the fuse 5', however, is held in an electrically conductive manner between contact sections 42' of a connection conductor 41' which is mounted in the selector insert 4'. The connection conductor 41' basically is of a substantially U-shape and comprises a short leg or leg member 43' which provides for an internal support at the selector insert 4'. The connection conductor 41' also comprises a long leg or leg member 44 which forms a connection conductor finger 44' and which contacts a selected one of the lateral connection tabs or contacts 21' depending upon the rotary position of the selector insert 4' in the head member 3'. The voltage selection is here made, therefore, by selecting the rotary position of the selector insert 4' in the head member 3'. The selected voltage is visible through a window 32' in the head member 3' as will be distinctly evident from FIG. 6 in which the voltage "220 V" is indicated.

To prevent the selector insert 4' from axially sliding out of the head member 3', a spring detent 33' is provided at the head member 3'. Depending upon the rotary position, this spring detent 33' snaps into one of the four locking windows 40' in the selector insert 4', so that the latter cannot drop out all by itself, rather requires withdrawal by, for example, using the finger nails. Due to the generally rectangular outer shape of the selector insert 4' and due to a corresponding rectangular shape of the interior of the head member 2' these two members are protected from being rotated relative to each other. Such protection, however, also can be achieved in a different way as, for example, by using a key and a corresponding groove or keyway or other suitable anti-rotation means. Of course, it will also be possible to provide a lesser or a greater number of selector insert positions and a correspondingly smaller or greater number of lateral connection tabs or contacts in the same manner which predominantly is a dimensioning problem.

In the aforedescribed three embodiments of the fuse holder according to the invention the connection conductors 41 and 41' are similarly designed. Each connection conductor 41 and 41' is constituted by a substantially U-shaped spring which is clampingly retained by the base portion of its U-shape in the related selector insert 4 or 4', respectively. The legs of the U-shaped connection conductors 41 and 41' extend convergingly from the base of the U-shape to the contacting sections or portions 42 and 42' for the fuse which possess a round or circular shape, like, for instance, a cylindrical surface and which thereafter extend in a diverging manner. The shorter leg or leg member 43 and 43', then, serves as a support at the inside of the related selector insert 4 and 4'. The longer leg or leg member 44 and 44' of the U-shaped connecting conductors 41 and 41', however, is designed as a connection conductive finger 44*a* and 44', respectively. Analogous connection conductors are provided for the fuses 105 and 105' which do not belong to the voltage selector. In the first and second embodiment of the inventive fuse holder such a design facilitates the use of a uniform socket member, while in the third embodiment of the fuse holder such design results in advantages with respect to space.

While there are shown and described present preferred embodiments of the invention, it is to be distinctly understood that the invention is not limited thereto, but may be otherwise variously embodied and practiced within the scope of the following claims. Accordingly,

What we claim is:

1. A fuse holder for use with different line voltages and including a line voltage indicator, said fuse holder comprising:

a socket member made of electrically insulating material and comprising an outer end provided with an opening;

said socket member containing a primary connection tab and a predetermined number of secondary lateral connection tabs each of which is located in a predetermined position;

a head member removably insertable along an insertion axis into said opening and made of electrically insulating material;

said head member being insertable along said insertion axis into said opening in a predetermined orientation to assume a locked position;

a selector insert removably insertable into said head member for voltage selection in one of a number of preselectable positions, each of which corresponds to a preselected line voltage;

said selector insert containing a connecting conductor which defines a contact section and a connecting conductor finger;

a fuse comprising an electrically conductive cap member at each one of its two ends and being insertable into said selector insert substantially parallel to said insertion axis to define an outer cap member and an inner cap member;

said contact section of said connecting conductor being in electrically conductive contact with said outer cap member of said fuse when said fuse is inserted into said selector insert;

said connecting conductive finger of said connecting conductor being in electrically conductive contact with a selected one of said predetermined number of lateral connection tabs in said socket member when said selector insert including said fuse is inserted into said head member in a preselected one of said preselectable positions corresponding to said preselected line voltage and when said head member is inserted into said socket member; and said inner cap member of said fuse being in electrically conductive contact with said primary connection tab of said socket member, when said fuse is inserted into said selector insert, when said selector insert including said fuse is inserted into said head member in said preselected position and when said head member is inserted into said socket member.

2. The fuse holder as defined in claim 1, further including:

means for ensuring that said head member is insertable into said socket member only in one predetermined position.

3. The fuse holder as defined in claim 1, wherein:

said selector insert is insertable into said head member in a direction which extends transversely relative to said insertion axis for selection of said preselected line voltage.

4. The fuse holder as defined in claim 3, wherein:

said socket member comprises a base;

said primary connection tab of said socket member being arranged adjacent said base; and said primary connection tab of said socket member being structured to be laterally resilient.

5. The fuse holder as defined in claim 4, wherein:

said primary connection tab is arranged opposite said secondary lateral connection tabs at said socket member.

6. The fuse holder as defined in claim 2, wherein:

said selector insert is selectively insertable into said head member along said insertion axis in a number of selectable rotary positions.

7. The fuse holder as defined in claim 6, wherein:

said primary connection tab at said socket member is structured as a base contact.

8. The fuse holder as defined in claim 1, wherein:

said head member is externaly visible through said opening when inserted into said socket member; and a selected one of said preselectable positions of said selector insert in said head member and thus a selected one of said preselected line voltages being discernible from the outside at said head member.

9. The fuse holder as defined in claim 1, further including:

connecting means provided in said head member and in said socket member for accommodating at least one further

10. The fuse holder as defined in claim 1, wherein:

said fuse in said fuse holder is protected from contact.

11. The fuse holder as defined in claim 1, further including:

an electrical plug; and said fuse holder being integrated with said plug.

12. The fuse holder as defined in claim 1, further including:

an electrical socket; and said fuse holder being integrated with said socket.

13. The fuse holder as defined in claim 1, wherein:

said primary connection tab forms a predetermined number of branched tabs; and each said branched tab being operatively associated with a respective one of said secondary lateral connection

14. The fuse holder as defined in claim 13, each said branched tab is located opposite a related operatively associated lateral connection tab.

* * * * *

UNITED STATES PATENT AND TRADEMARK OFFICE

CERTIFICATE OF CORRECTION

PATENT NO. : 4,489,300

DATED : December 18, 1984

INVENTOR(S) : PETER HOLLENSTEIN et al

It is certified that error appears in the above-identified patent and that said Letters Patent is hereby corrected as shown below:

Column 6, line 16, after "from" please insert --the socket member 2', the spring detents 30' and 30" must be--

Column 9, line 9, after "further" please insert --fuse.--

Column 10, line 11, after "connection" please insert --tabs.--

Column 10, line 12, after "claim 13," please insert --wherein:--

Signed and Sealed this

*Twenty-eighth* Day of *May 1985*

[SEAL]

*Attest:*

DONALD J. QUIGG

*Attesting Officer* *Acting Commissioner of Patents and Trademarks*